United States Patent [19]

Nakamaru et al.

[11] Patent Number: 4,758,861

[45] Date of Patent: Jul. 19, 1988

[54] TONER DENSITY CONTROL DEVICE IN AN ELECTROPHOTOGRAPHIC COPYING APPARATUS

[75] Inventors: Toru Nakamaru, Neyagawa; Kazuhiro Mizude, Toyonaka, both of Japan

[73] Assignee: Mita Industrial Co., Ltd., Japan

[21] Appl. No.: 89,875

[22] Filed: Aug. 27, 1987

[30] Foreign Application Priority Data

Aug. 29, 1986 [JP] Japan ..... 61-132811[U]

[51] Int. Cl.[4] ..... G03G 15/08

[52] U.S. Cl. ..... 355/14 D; 355/3 DD; 118/691

[58] Field of Search ..... 355/3 DD, 14 D, 3 TR, 355/3 R, 14 R; 118/663, 688, 689, 690, 691

[56] References Cited

U.S. PATENT DOCUMENTS

| | | | |
|---|---|---|---|
| 4,451,135 | 5/1984 | Okumura | 355/3 DD |
| 4,462,680 | 7/1984 | Ikeda | 355/14 D |
| 4,536,080 | 8/1985 | Hauser et al. | 355/14 D |
| 4,550,998 | 11/1985 | Nishikawa | 355/3 DD |
| 4,592,642 | 6/1986 | Imaizumi et al. | 355/3 DD |
| 4,592,645 | 6/1986 | Kanai et al. | 355/14 DD |

FOREIGN PATENT DOCUMENTS 57-74447 5/1982 Japan .

*Primary Examiner*—A. C. Prescott

*Attorney, Agent, or Firm*—Beveridge, DeGrandi & Weilacher

[57] ABSTRACT

A toner density control device comprising a toner density sensor to detect the density of the toner contained in the developer stored in a developing device, toner agitating means to agitate the developer stored in the developing device so as to charge the toner with frictional electricity, control standard value holding means which maintains as the control standard value the toner density that is lower by a specified value than that detected by the toner density sensor under a condition where the developer is agitated for some time by the toner agitating means during the initial stage after the developer is supplied into the developing device, and toner replenishment means which actuates under a condition when the toner density detected by the toner density sensor is lower than the control standard value, thereby controlling the toner density in the developing device in accordance with the control standard value maintained in a manner as stated above.

5 Claims, 3 Drawing Sheets

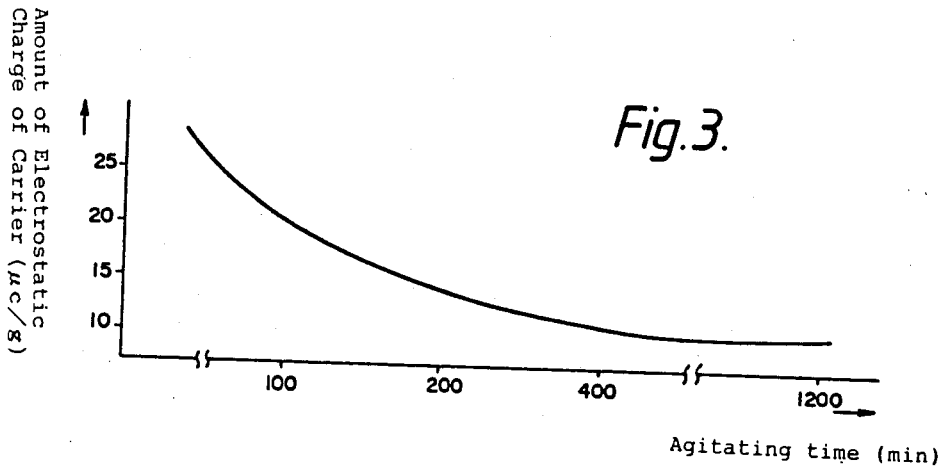
Fig. 3.
Fig. 4.
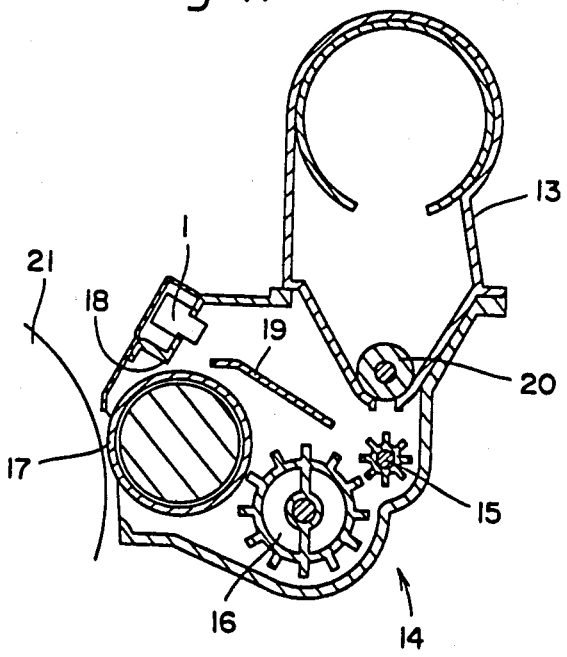

TONER DENSITY CONTROL DEVICE IN AN ELECTROPHOTOGRAPHIC COPYING APPARATUS

BACKGROUND OF THE INVENTION

The present invention relates to a toner density control device in an electrophotographic copying apparatus, and more particularly, to a device to control the density of toner held in a developing device which develops an electrophotographic latent image formed on the surface of a photoreceptor into an actual toner image.

In a conventional electrophotographic copying apparatus, a composition is generally employed wherein a developing device is disposed closely to a photoreceptor drum which rotaes in one direction, and an electrostatic latent image is developed by causing the toner contained in developer consisting of the toner and carrier placed in the developing device to be electrostaticaLly attracted with respect to an electrostatic latent image formed on the surface of a photoreceptor drum. An example of the above toner is the powder of mean grain diameter from 1 to 30 μm, preferably from 5 to 25 μm, which contains coloring agent and binding resin as its main constituents and additives such as charge control agent and offset inhibitor. Examples of the above carrier include glass beads; non-coated iron powder such as iron oxide powder and unoxidated iron powder; and coated magnetic powder of magnetic materials such as iron, cobalt, nickel, ferrite and magnetite which are coated with polymer such as acryl-based polymer, fluorine-based polymer and polyester, and they are normally from 50 to 2000 μm in diameter.

In a developing device having a composition such as above, it is required to maintain the density of the toner contained in the developer at an appropriate level to obtain proper development of electrostatic images. To satisfy this requirement, there has been provided a toner density control device (refer to the Japanese unexamined utility model publication No. 1982-74447) in which the developer having a predetermined toner density is supplied into a developing device and agitated, the toner density of the developer contained in the developing device is detected under such condition, and the value detected as above is maintained as the control standard value, so that the replenishment et cetra of the toner is caused to be accomplished when the toner density becomes lower than the control standard value of above.

In the toner density control device of the above composition, it may seem possible to accomplish precise toner density control by supplying a developing device with a developer having a predetermined toner density, but is is not so in practice because the amount of electrostatic charge of the carrier will not be stabilized until a considerably long time has passed after the developer is supplied into the developing device. If the density of the toner is controlled by using the control standard value, under the condition that the amount of electrostatic charge of the carrier is not stabilized, the density of an image will be caused to change following the change of the amount of electrostatic charge of the carrier.

To describe it more in detail, as shown in FIG. 3 in which the quantity of the developer is 1 kg, and the initial toner density when the developer is supplied into the developing device is 6 wt %, where mean diameter of the toner particle is about 11 μm and resistivity of the toner is about $1.8\times10^{11}$ ohm·cm, and mean diameter of the ferrite carrier particle is aobut 80 μm and resistivity of the carrier is about $8.0\times10^{10}$ ohm·cm. There is a large amount of the electrostatic charge of the carrier during the initial stage after the developer is supplied into the developing device. If the toner is caused to be electrostatically attracted on an electrostatic latent image formed on the surface of the photoreceptor drum under such condition, the image density tends to reduce when the electrostatic latent image is developed into an actual image because it is difficult for the toner to be separated from the carrier. If in this case an attempt is made to obtain a proper image density, it is necessary to establish a toner density as the control standard value which is higher than the toner density of the developer initially supplied into the developing device. By such arrangement, it becomes possible to replenish the shortage of the toner in the developer and maintain a high toner density so that an image of proper density can be obtained under a condition where a large amount of electrostatic charge of the carrier exists. If, however, a high toner density is maintained as the control standard value, inconvenience results when the amount of electrostatic charge of the carrier is reduced with the lapse of time and has come to be stabilized. This is because the toner density becomes too high conversely and so will the density of the obtained image becomes high, causing possible fog.

It can be considered possible to use the toner density as the control standard value after the amount of electrostatic charge of the carrier has been stabilized, by waiting until a long time has passed after the developer is supplied into the developing device, that is to say, by providing a long time for ageing. In such as case, a problem is involved where the agitating time becomes too long, requiring a long time before the control standard value is established. For this reason, this method is not adopted at all.

SUMMARY OF THE INVENTION

An object of the present invention is to provide a toner density control device in an electrophotographic copying apparatus in which a copied image is obtained by developing and converting an electrostatic latent image formed on the surface of a photoreceptor into a toner image and by transferring it onto the copying paper, capable of establishing a control standard value in a short period of time without regard to time-based variations in the amount of electrostatic charge of the carrier so that the toner density can be controlled to an appropriate level.

The above object can be achieved by providing a toner density control device as described in the following: The toner density control device comprises a toner density sensor which detects the density of the toner contained in a developer stored in a developing device, toner agitaging means which agitages the developer stored in the developing device to cause the toner to be charged with frictional electricity with respect to the carrier, control standard value holding means which maintains as the control standard value the toner density that is lower by a specified value than that detected by the toner density sensor under a condition where the developer is agitated by the toner agitating means during the initial stage after the developer is supplied into the developing device, and toner replenishment means which actuates under a condition when the toner density detected by the toner density sensor becomes lower than the control standard value of the above.

By the toner density control device of the above arrangement, the toner density sensor detects the toner density in the developing device, and the toner replenishment means actuates when the toner density detected by the toner density sensor is lower than the control standard value. In other words, in case the toner density in the developing device becomes lower than the control standard value, the toner is replenished into the developing device by the actuation of the toner replenishment means, the toner is agitated in the developing device by the toner agitating means with the toner being charged by the friction generated by agitation, and the toner is electrostatically attracted with respect to the electrostatic latent image formed on the surface of the photoreceptor drum, thereby causing the electrostatic latent image to be developed.

Under a condition where the toner is agitated by the toner agitating means during the initial stage after the developer is supplied, the control standard value of above is maintained by the control standard value holding means as a value which is lower by a specified value than the toner density which is detected by the toner density sensor. The above specified value is established, as the difference between the toner density under a condition where the developer is agitated for some time by the toner agitating means and is provided with some ageing after the developer is supplied into the developing device, and the toner density with which an optimum image density can be obtained under a condition where the amount of electrostatic charge of the carrier has been stabilized by waiting for a long time.

Because the toner density can be controlled in accordance with the control standard value of above, the toner density will not become excessively high and the appropriate image density can be obtained even if the amount of electrostatic charge of the carrier is reduced after a lapse of a specified time after the developer is supplied into the developing device.

In the toner density control device according to this invention, it is preferable that the control standard value holding means maintains the toner density which is lower by a specified value than the detected toner density, as the normal control standard value, and also maintains further lower density as the second control standard value to detect the toner empty condition. In this case, it is possible not only to control the toner density under normal condition but also to detect the toner empty condition precisely.

The advantages of the invention will become further apparent from the following description taken in conjunction with the attached drawings.

BRIEF DESCRIPTION OF THE DRAWINGS

FIG. 3 is a graph illustrating a time-based variations of the amount of electrostatic charge of the carrier; and FIG. 4 is a schematic diagram of the developing device.

DETAILED DESCRIPTION OF THE EMBODIMENTS

Figure 1:
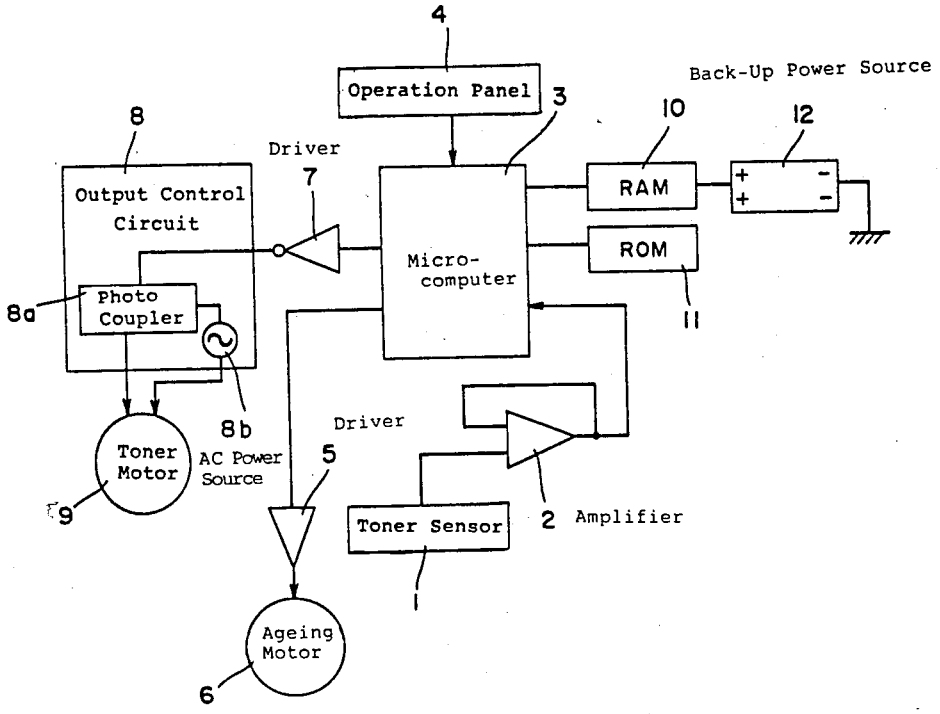
FIG. 1 is a block diagram showing an embodiment of the toner density control device of this invention.

FIG. 4 is a schematic diagram which shows a developing device having a toner hopper 13 at an upper part thereof. At prescribed positions in the developing device 14 are disposed agitating rollers 15, 16, developing roller 17, brush height adjusting member 18, guide member 19, and toner sensor 1. Inside of the above toner hopper 13 is disposed a toner replenishment roller 20.

A developer to be supplied in the developing device 14 contains a carrier and a toner. The mean diameter of the carrier particle is preferably 70 to 100 μm and resistivity is preferably $2.0\times10^{10}$ to $1.4\times10^{11}$ ohm·cm. The mean diameter of the toner particle is preferably 10 to 15 μm and resistivity is 1.7 to $1.9\times10^{11}$ ohm·cm. Under the above condition of carrier and toner, the toner density control device of the invention can be suitably adopted.

The developing device operates as follows when the toner density is reduced. When the toner density is reduced, the toner is caused to drop into the developing device 14 by causing the toner replenishment roller 20 to rotate. The dropped toner is mixed by the agitating rollers 15, 16 to charge the toner with frictional electricity. By doing so, the toner is caused to be attracted on the developing roller 17 which rotaes in one direction. The amount of toner attracted on the developing roller 17 is controlled by the brush height adjusting member 18, and the toner is transferred onto the electrostatic image formed on the surface of the photoreceptor drum 21 while the developing roller 17 rotates, thereby accomplishing development of the electrostatic latent image.

FIG. 1 is a block diagram showing the electrical arrangement of an embodiment of the toner density control device according to this invention.

The toner density detection signal with respect to the toner in the body of the developing device 14 produced from the toner sensor 1 is sent, by means of the amplifier 2, to the microcomputer 3 which incorporates an A/D converter. The signal from the operation panel 4 is supplied to the microcomputer 3. The control signal from the microcomputer 3 is supplied, by means of the driver 5, to the ageing motor 6 which rotates the agitating rollers 15, 16 and developing roller 17, and is also supplied, by means of the driver 7 and the output control circuit 8, to the toner motor 9 which rotates the toner replenishment roller 20. The output control circuit 8 has the photocoupler **8*a* which is driven by the output signal from the driver 7 and the AC power source 8*b* which supplies the operating voltage to the toner motor 9. The microcomputer 3 is connected with the RAM 10 and ROM 11, while the RAM 10 is connected with the back-up power source 12**.

Figure 2:
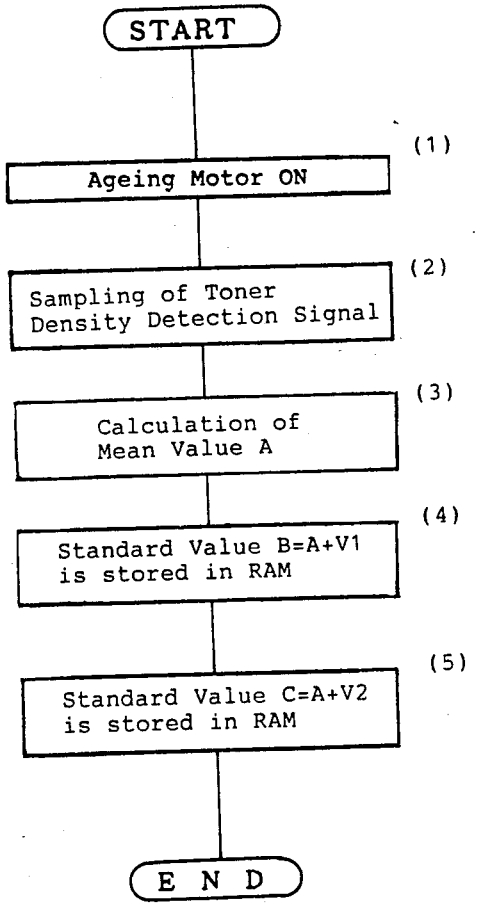
FIG. 2 is a flowchart describing operations to set the control standard value to accomplish the toner density control.

FIG. 2 is a flowchart describing operations to set up the control standard value of the toner density control device of the above arrangements. When setting up the control standard value by using this flowchart, the developer is first supplied into the body of the developing device 14. Then, by driving the ageing motor 6 for a predetermined time (about two minutes for example) in the step (1), the toner contained in the developing device 14 is agitated so as to cause the toner to be charged with frictional electricity. Under the above condition, the toner density detection signal is sampled (sampling pulse interval is two seconds, for example) from the toner sensor 1 for a predetermined time (for three minutes, for example) in the step (2), and the mean value A of the sampled data is calculated in the step (3). The mean value A is calculated by the following equation: $A=\Sigma x_i/n$, where n represents the sampling data number and $x_i$ the ith sampling data. Next, in the step (4), the mean value A is added with the value v1 which is selected according to the combination of the toner and carrier comprising the developer to be used. The value v1 may be different depending on the type and composition of the toner and carrier which constitute the developer. For example, when a toner particle of about 11 μm mean diameter and resistivity of $1.8\times10^{11}$ ohm·cm is mixed to a ferrite carrier particle of about 80 μm mean diameter and resistivity of $8.0\times10^{10}$ ohm·cm by 6.0 wt. %, v1 becomes 0.5. The result of addition A with v1 is stored into the RAM 10 to make the control standard value B used for toner density control, and in the step (5), result of addition of the mean value A of above and v2 (where v2 is greater than v1, for example, v2=0.7 when the toner and carrier are of the abovementioned materials) is stored into the RAM 10 to make the control standard value C used for detecting the toner empty level. Each of the control standard values B and C can be established in the manner stated above.

In addition to the above description, the toner sensor 1 produces voltage signals corresponding to the toner density, and the output voltage is increased by one volt when the toner density is reduced by one percent. Therefore, the mean value A will be produced by the voltage value, and the control standard values B and C are also produced by the voltage values. The voltage values according to the control standard values B and C are selected corresponding to a condition where the toner density is reduced by v1 percent and v2 percent respectively from the mean value A of above.

After respective control standard values of B and C are established as stated above, the driving of the toner motor 9 is controlled by comparing the toner density detection signal produced from the toner sensor 1 with the control standard value B of above. By such comparison, it becomes possible to maintain the toner density in the body of the developing device 14 within an appropriate range, so copies of appropriate range density can be obtained.

In case a condition occurs where the toner density is not restored even by driving the toner motor 9, that is to say, the toner does not exist in the toner hopper 13, the toner density will be reduced gradually as the copying operations are accomplished and the toner density detection signal will reach the control standard value C which corresponds with the toner empty level. Therefore, in case such condition is detected, an indicator (not shown in the diagram) indicates that the toner replenishment should be accomplished. In addition to this indication, if continued copying operations are performed, there might be a high possibility of deteriorated developer, so the deterioration of the developer is prevented by prohibiting continuous copying operations of a number of copies, for example.

According to the invention as described above, because the control standard value can be established by allowing the time for stabilization of the amount of electrostatic charge of the carrier after the developer is set and provided with ageing for a relatively short period of time, precise control of the toner density can be accomplished.

The invention has been described in detail as above in accordance with the embodiments of the toner density control device by referring to the attached drawings, but this invention will not be limited to such embodiments and should be understood that various other changes can be provided unless they depart from the scope and the spirit of the invention.

What is claimed is:

1. A toner density control device adopted to an electrophotographic copying apparatus to obtain copies of images by developing an electrostatic latent image formed on the surface of a photoreceptor into a toner image and by transferring the toner image onto a copying paper, comprising; a toner density sensor which detects density of a toner contained in a developer stored in a developing device, toner agitating means which agitates the developer contained in the developing device to cause the toner to be charged with frictional electricity, control standard value holding means which maintains as a control standard value a toner density that is lower by a specified value than the toner density detected by the toner density sensor under a condition where the developer is agitated by the toner agitating means during an initial stage after the developer is supplied into the developing device, and toner replenishment means which actuates when the toner density detected by the toner density sensor becomes lower than the control standard value of above.

2. A toner density control device according to claim 1, wherein the control standard value holding means maintains as the control standard value the toner density that is lower by said specified value than the detected toner density and maintains a further lower toner density as a control standard value to determine a toner empty condition.

3. A toner density control device according to claim 1, wherein the toner density which is lower by the specified value than the toner density detected by the toner density sensor under a condition where the developer is agitated by the toner agitating means during the initial stage after the developer is supplied into the developing device, corresponds with a toner density with which an optimum image density can be obtained under a condition where an amount of electrostatic charge of the carrier in the developer is stabilized after a lapse of long time from the developer is supplied into the developing device.

4. A toner density control device according to claim 1, wherein the developer contains a carrier consisting of particles having 70 to 100 μm diameter and resistivity of from $2.0\times10^{10}$ to $1.4\times10^{11}$ ohm·cm.

5. A toner density control device according to claim 1, wherein the control standard value holding means is consisted of a microcomputer.

* * * * *